US006060229A

United States Patent [19]

Eichorst et al.

[11] Patent Number: 6,060,229

[45] Date of Patent: May 9, 2000

[54] IMAGING ELEMENT CONTAINING AN ELECTRICALLY-CONDUCTIVE LAYER AND A TRANSPARENT MAGNETIC RECORDING LAYER

[75] Inventors: Dennis J. Eichorst, Fairport; Debasis Majumdar, Rochester; Catherine A. Falkner, Rochester; Paul D. Yacobucci, Rochester, all of N.Y.

[73] Assignee: Eastman Kodak Company, Rochester, N.Y.

[21] Appl. No.: 09/172,901

[22] Filed: Oct. 15, 1998

[51] Int. Cl.[7] ..... G03C 1/89; G03C 1/76

[52] U.S. Cl. ..... 430/529; 430/527; 430/530; 430/531; 430/533; 430/140

[58] Field of Search ..... 430/527, 529, 430/530, 531, 140, 533

[56] References Cited

U.S. PATENT DOCUMENTS

| | | | |
|---|---|---|---|
| 3,782,947 | 1/1974 | Krall . | |
| 4,203,769 | 5/1980 | Guestaux | 430/631 |
| 4,279,945 | 7/1981 | Audran et al. | 430/140 |
| 4,302,523 | 11/1981 | Audran et al. | 430/140 |
| 5,147,768 | 9/1992 | Sakakibara | 430/140 |
| 5,217,804 | 6/1993 | James et al. | 428/129 |
| 5,229,259 | 7/1993 | Yokota | 430/140 |
| 5,294,525 | 3/1994 | Yamauchi et al. | 430/530 |
| 5,336,589 | 8/1994 | Mukunoki et al. | 430/501 |
| 5,360,706 | 11/1994 | Anderson et al. | 430/529 |
| 5,380,584 | 1/1995 | Anderson et al. | 430/529 |
| 5,382,494 | 1/1995 | Kudo et al. | 430/140 |
| 5,395,743 | 3/1995 | Brick et al. | 430/496 |
| 5,413,900 | 5/1995 | Yokota | 430/495 |
| 5,427,835 | 6/1995 | Morrison et al. | 430/527 |
| 5,427,900 | 6/1995 | James et al. | 430/496 |
| 5,432,050 | 7/1995 | James et al. | 430/496 |
| 5,439,785 | 8/1995 | Boston et al. | 430/530 |
| 5,443,944 | 8/1995 | Krafft et al. | 430/529 |
| 5,457,013 | 10/1995 | Christian et al. | 430/496 |
| 5,459,021 | 10/1995 | Ito et al. | 430/527 |
| 5,498,512 | 3/1996 | James et al. | 430/496 |
| 5,514,528 | 5/1996 | Chen et al. | 430/530 |
| 5,576,163 | 11/1996 | Anderson et al. | 430/529 |
| 5,665,498 | 9/1997 | Savage et al. | 430/529 |
| 5,674,654 | 10/1997 | Zumbulyadis et al. | 430/41 |
| 5,707,791 | 1/1998 | Ito et al. | 430/527 |
| 5,709,984 | 1/1998 | Chen et al. | 430/527 |
| 5,718,995 | 2/1998 | Eichorst et al. | 430/527 |
| 5,731,119 | 3/1998 | Eichorst et al. | 430/527 |

*Primary Examiner*—Richard L. Schilling
*Attorney, Agent, or Firm*—Carl F. Ruoff; Doreen M. Wells

[57] ABSTRACT

The present invention is an imaging element which includes a support, an image-forming layer superposed on the support, an electrically-conductive layer superposed on the support, and a transparent magnetic recording layer overlying the electrically-conductive layer. The electrically-conductive layer includes electrically-conductive agents dispersed in a film-forming binder which is a sulfonated polymer and the transparent magnetic recording layer contains ferromagnetic particles dispersed in an aromatic polyester binder having a $T_g$ of greater than 150° C.

18 Claims, No Drawings

IMAGING ELEMENT CONTAINING AN ELECTRICALLY-CONDUCTIVE LAYER AND A TRANSPARENT MAGNETIC RECORDING LAYER

CROSS REFERENCE TO RELATED APPLICATIONS

This application relates to commonly assigned copending U.S. Ser. No. 09/172,897 filed simultaneously herewith. This application relates to commonly assigned copending U.S. Ser. No. 09/172,878, filed simultaneously herewith. This application relates to commonly assigned copending U.S. Ser. No. 09/173,439, filed simultaneously herewith.

FIELD OF THE INVENTION

This invention relates generally to imaging elements including a support, an image-forming layer, a transparent, electrically-conductive layer, and a transparent, magnetic recording layer. More specifically, this invention relates to photographic and thermally-processable imaging elements having one or more sensitized silver halide emulsion layers, an electrically-conductive layer and a transparent, magnetic recording layer overlying the electrically-conductive layer.

BACKGROUND OF THE INVENTION

It is well known to include in various kinds of imaging elements, a transparent layer containing magnetic particles dispersed in a polymeric binder. The inclusion and use of such transparent magnetic recording layers in light-sensitive silver halide photographic elements has been described in U.S. Pat. Nos. 3,782,947; 4,279,945; 4,302,523; 5,217,804; 5,229,259; 5,395,743; 5,413,900; 5,427,900; 5,498,512; and others. Such elements are advantageous because images can be recorded by customary photographic processes while information can be recorded simultaneously into or read from the magnetic recording layer by techniques similar to those employed for traditional magnetic recording art.

The transparent magnetic recording layer must be capable of accurate recording and playback of digitally encoded information repeatedly on demand by various devices such as a camera or a photofinishing or printing apparatus. The layer also must exhibit excellent running, durability (i.e., abrasion and scratch resistance), and magnetic head-cleaning properties without adversely affecting the imaging quality of the photographic elements. However, this goal is extremely difficult to achieve because of the nature and concentration of the magnetic particles required to provide sufficient signal to write and read magnetically stored data and the effect of any noticeable color, haze or grain associated with the magnetic layer on the optical density and granularity of the photographic elements. These goals are particularly difficult to achieve when magnetically recorded information is stored and read from the photographic image area. Further, because of the curl of the photographic element, the magnetic layer must be held more tightly against the magnetic heads than in conventional magnetic recording in order to maintain planarity at the head-media interface during recording and playback operations. Thus, all of these various characteristics must be considered both independently and cumulatively in order to arrive at a commercially viable photographic element containing a transparent magnetic recording layer that will not have a detrimental effect on the photographic imaging performance and still withstand repeated and numerous read-write operations by a magnetic head.

Problems associated with the generation and discharge of electrostatic charge during the manufacture and use of photographic film and paper have been recognized for many years by the photographic industry. The accumulation of charge on film or paper surfaces leads to the attraction of dust, which can produce physical defects. The discharge of accumulated charge during or after the application of the sensitized emulsion layers can produce irregular fog patterns or static marks in the emulsion. The severity of the static problems has been exacerbated greatly by the increases in sensitivity of new emulsions, increases in coating machine speeds, and increases in post-coating drying efficiency. The charge generated during the coating process results primarily from the tendency of webs of high dielectric constant polymeric film base to undergo triboelectric charging during winding and unwinding operations, during conveyance through the coating machines, and during post-coating operations such as slitting, perforating, and spooling. Static charge can also be generated during the use of the finished photographic product. For example, in an automatic camera, because of the repeated motion of the photographic film in and out of the film cassette, there is the added problem of the generation of electrostatic charge by the movement of the film across the magnetic heads and by the repeated winding and unwinding operations, especially in a low relative humidity environment. The accumulation of charge on the film surface results in the attraction and adhesion of dust to the film. The presence of dust not only can result in the introduction of physical defects and the degradation of the image quality of the photographic element but also can result in the introduction of noise and the degradation of magnetic recording performance (e.g., S/N ratio, "drop-outs", etc.). This degradation of magnetic recording performance can arise from various sources including signal loss resulting from increased head-media spacing, electrical noise caused by discharge of the static charge by the magnetic head during playback, uneven film transport across the magnetic heads, clogging of the magnetic head gap, and excessive wear of the magnetic heads. In order to prevent these problems arising from electrostatic charging, there are various well known methods by which an electrically-conductive layer can be introduced into the photographic element to dissipate any accumulated electrostatic charge.

Antistatic layers containing electrically-conductive agents can be applied to one or both sides of the film base as subbing layers either beneath or on the side opposite to the silver halide emulsion layers. An antistatic layer also can be applied as an outer layer coated either over the emulsion layers or on the side opposite to the emulsion layers or on both sides of the film base. Typically, in photographic elements of prior art comprising a transparent magnetic recording layer, the antistatic layer was preferably present as a backing layer underlying the magnetic recording layer.

The use of such electrically-conductive layers containing suitable semi-conductive metal oxide particles dispersed in a film-forming binder in combination with a transparent magnetic recording layer in silver halide imaging elements has been described in the following examples of the prior art. Photographic elements including a transparent magnetic recording layer and a transparent electrically-conductive layer containing fine granular particles of a semi-conductive crystalline metal oxide such as zinc oxide, titania, tin oxide, alumina, indium oxide, silica, complex or compound oxides thereof, both located on the backside of the film base have been described in U.S. Pat. Nos. 5,147,768; 5,229,259; 5,294,525; 5,336,589; 5,382,494; 5,459,021; and others. Of these conductive metal oxides, antimony-doped tin oxide is preferred. A wide variety of polymeric binders are indicated as suitable for use in the electrically-conductive layer of the photographic element, with gelatin and cellulose triacetate being the binders most commonly taught. Suitable binders for the magnetic layer are indicated to be thermoplastic resins having a $T_g$ in the range of from −40° C. to 150° C. in '768, '259, '589, and '021. U.S. Pat. Nos. 5,294,525 and 5,382,494 indicate suitable thermoplastic resins having a $T_g$ in the range of from −40° C. to 180° C. and a preferred range of 40° C. to 150° C. Vinyl chloride resins and cellulose derivatives such as cellulose nitrate, cellulose diacetate, and cellulose triacetate are typically indicated as the preferred thermoplastic resins for use in the magnetic layer. In addition hydrophilic binders such as gelatin are suitable. Photographic elements including a transparent magnetic recording layer and a transparent electrically-conductive layer containing zinc antimonate or indium antimonate, both located on the backside of the film base have been described in U.S. Pat. No. 5,457,013.

Photographic elements including an electrically-conductive layer containing colloidal vanadium pentoxide and a transparent magnetic recording layer have been disclosed in U.S. Pat. Nos. 5,395,743; 5,427,900; 5,432,050; 5,498,512; 5,514,528 and others. The preferred binder for the magnetic layer in the above U.S. Patents is cellulose diacetate. Vinylidene chloride containing polymers are disclosed as a preferred binder for electrically-conductive layers containing colloidal vanadium oxide. U.S. Pat. No. 5,514,528 also teaches an antistatic layer composed of colloidal vanadium oxide and an aqueous dispersible polyester coated on a subbed polyester support and subsequently overcoated with a transparent magnetic recording layer containing cellulose acetate. Conductive layers containing colloidal vanadium pentoxide prepared as described in U.S. Pat. No. 4,203,769 can exhibit low surface resistivities at very low weight fractions and dry weight coverages of vanadium oxide, low optical losses, and excellent adhesion of the conductive layer to film supports. However, colloidal vanadium pentoxide readily dissolves at high pH in developer solution during wet processing and must be protected by a nonpermeable, overlying barrier layer. The magnetic layer inherently can serve as a nonpermeable barrier layer, when overlying a conductive layer containing colloidal vanadium oxide. However, if the magnetic layer contains a high level of reinforcing filler particles, such as gamma aluminum oxide or silica fine particles, it must be crosslinked using suitable cross-linking agents in order to preserve the desired barrier properties, as taught in U.S. Pat. No. 5,432,050.

Alternatively, a film-forming sulfopolyester latex or polyesterionomer binder can be combined with the colloidal vanadium pentoxide in the conductive layer to minimize degradation during processing as taught in U.S. Pat. Nos. 5,360,706; 5,380,584; 5,427,835; 5,576,163; and others. Furthermore, it is disclosed that the use of a polyesterionomer can improve solution stability of colloidal vanadium pentoxide containing dispersions. Instability of vanadium pentoxide gels in the presence of various binders is well known and several specific classes of polymeric binders have been identified for improved stability or coatability, for example in U.S. Pat. Nos. 5,427,835; 5,439,785; 5,360,706; and 5,709,984. U.S. Pat. No. 5,427,835 teaches the use of sulfopolymers in combinations with vanadium oxide preferably prepared from hydrolysis of oxoalkoxides for antistatic applications. Sulfopolymers indicated to be useful include sulfopolyester, ethylenically-unsaturated sulfolpolymers, sulfopolyurethanes, sulfopolyurethane/-polyureas, sulfopolyester polyols, sulfopolyols, sulfonate containing polymers such as poly(sodiumstyrene sulfonate) and alkylene oxide-co-sulfonate containing polyesters.

U.S. Pat. No. 5,718,995 teaches an antistatic layer containing an electrically-conductive agent and a specified polyurethane binder having excellent adhesion to polyester supports and to an overlying transparent magnetic layer. The specified polyurethane is an aliphatic, anionic polyurethane having an ultimate elongation to break of at least 350 percent, however, sulfonated polyurethanes are neither taught nor claimed. Comparative Example 1 of '995 demonstrates that it is difficult to achieve adequate adhesion to glow discharge treated polyethylene naphthalate for a magnetics backing package composed of a solvent coated cellulosic-based magnetic layer and an antistatic layer containing colloidal vanadium pentoxide and either a sulfopolyester or interpolymer of vinylidene chloride cited as preferred binders in the above mentioned U.S. Patents. It was further demonstrated in Comparative Examples 9–13 that electrically-conductive layers composed of a non-preferred polyurethane binder also did not provide adequate adhesion. Electrically-conductive agents taught for use in combination with the specified polyurethane binder included tin oxide, colloidal vanadium oxide, zinc antimonate, indium antimonate and carbon fibers. It was further disclosed that electrically-conductive polymers as exemplified by polyanilines and polythiophenes may also be used. However, it was indicated that a coating composition consisting of the specified polyurethane binder and colloidal vanadium oxide had limited shelf-life (less then 48 hrs). Similarly, copending and commonly assigned U.S. Ser. No. 09/172,897 discloses as Comparative Examples unacceptable solution stability for electrically-conductive layers containing a non-sulfonated polyurethane binder and either polypyrrole or colloidal vanadium oxide.

The use of crystalline, single-phase, acicular, conductive metal-containing particles in transparent conductive layers for various types of imaging elements also containing a transparent magnetic recording layer has been disclosed in U.S. Pat. No. 5,731,119. Preferred binders include gelatin, aqueous dispersed polyurethanes, polyesterionomers, cellulose derivatives, and vinyl-containing copolymers. Preferred binders for the magnetic layer include gelatin, polyurethanes, vinyl-chloride based copolymers and cellulose esters, particularly cellulose diacetate and cellulose triacetate. Comparative Example 7 of '119 indicates poor adhesion for a magnetic layer containing cellulose diacetate and cellulose triacetate overlying an electrically-conductive layer containing granular tin oxide particles dispersed in a sulfonated polyester, AQ55D commercially available from Eastman Chemicals.

The use of electronically-conductive polythiophenes in an electrically-conductive layer either below or above a transparent magnetic layer is taught is U.S. Pat. No. 5,443,944. Suitable polythiophenes are prepared by oxidative polymerization of thiophene in the presence of polymeric carboxylic acids or polymeric sulfonic acids. Examples of polythiophene-containing antistatic layers either had no polymeric film-forming binder, a vinylidene chloride based terpolymer, or a polyurethane. The polyurethane binder was indicated to give "insufficient antistatic effects." Binders for the magnetic layer included cellulose triacetate, polymethylmethacrylate and polyurethane.

An electrically-conductive layer containing poly(3,4-ethylene dioxypyrrole/styrene sulfonate) in a film-forming binder used in combination with a transparent magnetic layer is claimed in U.S. Pat. No. 5,665,498. Similarly, an electrically-conductive layer containing polypyrrole/poly (styrene sulfonic acid) used in combination with a transparent magnetic layer is disclosed in U.S. Pat. No. 5,674,654.

Suitable film-forming binders are indicated to include aqueous dispersions of polyurethanes or polyesterionomers. However, neither polyurethane film-forming binders nor a transparent recording layer overlying the electrically-conductive layer are taught. Sulfonated polyester binders as taught in '498 and '654 have resulted in insufficient adhesion to an overlying cellulosic magnetic layer as disclosed in copending and commonly assigned U.S. Ser. No. 09/172,897.

U.S. Pat. No. 5,707,791 claims a silver halide element having a resin layer composed of an antistatic agent and an aqueous-dispersible polyester resin or an aqueous-dispersible polyurethane resin, and magnetic layer coated on the resin layer. The antistatic agent is selected from a conductive polymer and a metal oxide. Suitable methods of making the polyurethane water dispersible are disclosed to include introducing a carboxyl group, sulfone group or tertiatry amino group into the polyurethane. Furthermore, the conductive polymers indicated are preferably anionic or cationic ionically-conducting polymers. Electronically-conducting polymers such as polythiophenes, polyanilines, or polypyrroles are not indicated. Thermoplastic resin suitable as polymeric binders for the magnetic layer are disclosed to have a $T_g$ of from −40° C. to 150° C. Preferred polymeric binders are cellulose esters, and more specifically cellulose diacetate is particularly preferred.

U.S. Pat. No. 5,382,494 claims a silver halide photographic material having a magnetic recording layer on a backing layer. The backing layer contains inorganic particles of a metal oxide which have at least one surface being water-insoluble, and dispersed in a binder in a proportion of 75.0% to 660% by weight of the binder. Suitable binders include a polyester polyurethane resin, polyether polyurethane resin, polycarbonate polyurethane resin and a polyester resin. It is further disclosed that "the backing layer is allowed to contain an organic particles in place of the inorganic particles." Suitable thermoplastic resins to be used as the polymeric binder for either the electrically-conductive layer or magnetic layer are to have a $T_g$ within the range of −40° C. to 180° C., and preferably 30° C. to 150° C.

U.S. Pat. No. 5,294,525 discloses a silver halide photographic material containing a transparent magnetic layer, a conductive layer containing conductive particles and a binder. The binder for the conductive layer contains a polar functional group consisting of $—SO_2M$, $—OSO_3M$ and $—P(=O)(OM_1)(OM_2)$ wherein M is hydrogen, sodium, potassium, or lithium; $M_1$ and $M_2$ are the same or different and represent hydrogen, sodium, potassium, lithium, or an alkyl group. Suitable binder resins include polyvinyl chloride resins, polyurethane resins, polyester resins and polyethylene type resins. However, '525 additionally claims the binder for the magnetic layer contain a polar functional group indicated above. Suitable thermoplastic resins for the binder of the magnetic layer are those which have a softening point of 150° C. or less, an average molecular weight of 10,000 to 200,000 and a degree of polymerization of 200 to 2000. The required addition of a polar functional group in the binder of the magnetic layer is undesirable for the physical and chemical properties of the magnetic layer. Furthermore, increased permeability of the magnetic binder can potentially result in chemical change of the magnetic particles and consequently alter the desired magnetic signal. In addition, the barrier properties of the magnetic layer can be degraded by the addition of polar functional groups.

Because the requirements for an electrically-conductive layer to be useful in an imaging element are extremely demanding, the art has long sought to develop improved conductive layers exhibiting a balance of the necessary chemical, physical, optical, and electrical properties. As indicated hereinabove, the prior art for providing electrically-conductive layers useful for imaging elements is extensive and a wide variety of suitable electroconductive materials have been disclosed. However, there is still a critical need in the art for improved conductive layers which can be used in a wide variety of imaging elements, which can be manufactured at a reasonable cost, which are resistant to the effects of humidity change, which are durable and abrasion-resistant, which do not exhibit adverse sensitometric or photographic effects, which exhibit acceptable adhesion to overlying or underlying layers, which exhibit suitable cohesion, and which are substantially insoluble in solutions with which the imaging element comes in contact, such as processing solutions used for photographic elements. Further, to provide both effective magnetic recording properties and effective electrical-conductivity for an imaging element, without impairing its imaging characteristics, poses a considerably greater technical challenge.

The above indicated U.S. Patents could provide several advantages, e.g., improved solution stability, good conductivity, and good adhesion to polyester supports, for a variety of electrically-conductive layers containg various conductive agents. However, it has also been indicated that adhesion of an overlying magnetic layer to sulfonated polymers may be insufficient for several applications. Consequently, it is toward the objective of providing a useful combination of a transparent magnetic recording layer and an electrically-conductive layer which can be comprised of a wide variety of electrically-conductive agents and have acceptable adhesion to underlying and overlying layers that more effectively meet the diverse needs of imaging elements, especially those of silver halide photographic films, but also of a wide variety of other types of imaging elements than those of the prior art that the present invention is directed.

SUMMARY OF THE INVENTION

The present invention is an imaging element which includes a support, an image-forming layer superposed on the support, an electrically-conductive layer superposed on the support, and a transparent magnetic recording layer overlying the electrically-conductive layer. The electrically-conductive layer includes electrically-conductive agents dispersed in a film-forming binder which is a sulfonated polymer and the transparent magnetic recording layer contains ferromagnetic particles dispersed in an aromatic polyester binder having a $T_g$ of greater than 150° C.

DETAILED DESCRIPTION OF THE INVENTION

The present invention provides an imaging element for use in an image-forming process including a support, at least one imaging layer, at least one electrically-conductive layer, wherein the electrically-conductive layer contains electrically conductive agents dispersed in a sulfonated polymeric film-forming binder, and at least one transparent magnetic recording layer overlying the at least one electrically-conductive layer, wherein the transparent magnetic recording layer contains ferromagnetic particles dispersed in an aromatic polyester binder having a $T_g$ of greater than 150° C., preferably 180° C., and most preferably greater than 200° C. The sulfonated polymeric film-forming binder provides excellent solution stability or compatibility with a vast array of electrically-conductive agents, particularly with electrically-conductive polymers and colloidal vanadium oxide, relative to non-sulfonated polymers. Furthermore, the sulfonated binder provides excellent adhesion to subbed or surface treated polyester supports and can provide good adhesion to an overlying transparent magnetic recording layer. The aromatic polyester binder of the magnetic recording layer provides improved adhesion of the magnetic layer to the electrically-conductive layer, particularly after photographic processing, than magnetic recording layers of prior art.

Imaging elements including a transparent magnetic recording layer are described, for example, in U.S. Pat. Nos. 3,782,947; 4,279,945; 4,302,523; 4,990,276; 5,215,874; 5,217,804; 5,252,441; 5,254,449; 5,335,589; 5,395,743; 5,413,900; 5,427,900 and others; in European Patent Application No. 0 459,349 and in Research Disclosure, Item No. 34390 (November, 1992). Such elements are advantageous because they can be employed to record images by the customary photographic process while at the same time additional information can be recorded on and read from the magnetic layer by techniques similar to those employed in the magnetic recording art. A transparent magnetic layer can be positioned in an imaging element in any of various locations. For example, it can overlie one or more image-forming layers, underlie one or more image-forming layers, be interposed between image-forming layers, serve as a subbing layer for an image-forming layer, be coated on the side of the support opposite an image-forming layer or can be incorporated into an image-forming layer.

Conductive layers in accordance with this invention are broadly applicable to photographic, thermographic, electrothermographic, photothermographic, dielectric recording, dye migration, laser dye-ablation, thermal dye transfer, electrostatographic, electrophotographic imaging elements, and others. Details with respect to the composition and function of this wide variety of imaging elements are provided in U.S. Pat. Nos. 5,719,016 and 5,731,119. Conductive layers of this invention may be present as a backing, subbing, intermediate or protective overcoat layer on either or both sides of the support.

The electrically conductive layer of the present invention comprises an electrically conductive agent dispersed with a sulfonated polymer film-forming binder, and can be coated out of an aqueous system on a suitable imaging element. The electrically conductive agent can be chosen from any or a combination of electrically-conductive particles, electrically-conductive "amorphous" gels, carbon fibers, preferably nanofibers, electronically-conductive polymers, or conductive clays.

Electronically conductive particles which may be used in the electrically conductive antistatic layer include, e.g., conductive crystalline inorganic oxides, conductive metal antimonates, and conductive inorganic non-oxides. Crystalline inorganic oxides may be chosen from ZnO, $TiO_2$, $SnO_2$, $Al_2O_3$, $In_2O_3$, SiO2, MgO, BaO, $MoO_3$, $WO_3$, and $V_2O_5$ or composite oxides thereof, as described in, e.g., U.S. Pat. Nos. 4,275,103; 4,394,441; 4,416,963; 4,418,141; 4,431,764; 4,495,276; 4,571,361; 4,999,276 and 5,122,445. The use of antimony-doped tin oxide at an antimony doping level of at least 8 atom percent and having an X-ray crystallite size less than 100 Å and an average equivalent spherical diameter less than 15 nm but no less than the X-ray crystallite size as taught in U.S. Pat. No. 5,484,694 is most preferred. In addition acicular conductive particles as described in U.S. Pat. Nos. 5,719,016 and 5,831,119 and incorporated herein by reference with respect to suitable acicular conductive particles are also preferred as antistatic agents.

Electronically conductive particles which may be used in the electrically conductive antistatic layer also include semiconductive metal oxides, heteroatom donor-doped metal oxides, metal oxides containing oxygen deficiencies, conductive metal carbides, conductive metal nitrides, conductive metal silicides, and conductive metal borides, doped metal oxides, metal oxide particles, metal oxides containing oxygen deficiencies, doped tin oxide particles, antimony-doped tin oxide particles, niobium-doped titanium dioxide particles, metal nitrides, metal carbides, metal suicides, metal borides or tin-doped indium sesquioxide.

Electronically conductive particles which may be used in the electrically conductive antistatic layer also include acicular doped metal oxides, acicular metal oxide particles, acicular metal oxides containing oxygen deficiencies, acicular doped tin oxide particles, acicular antimony-doped tin oxide particles, acicular niobium-doped titanium dioxide particles, acicular metal nitrides, acicular metal carbides, acicular metal silicides, acicular metal borides or acicular tin-doped indium sesquioxide.

Conductive metal antimonates suitable for use in the antistatic layer include those as disclosed in, e.g., U.S. Pat. Nos. 5,368,995 and 5,457,013. Conductive inorganic non-oxides suitable for use as conductive particles in the antistatic layer include: TiN, $TiB_2$, TiC, $NbB_2$, WC, $LaB_6$, $ZrB_2$, MoB, and the like, as described, e.g., in Japanese Kokai No. 4/55492, published Feb. 24, 1992.

The conductive particles present in the electrically conductive antistatic layer are not specifically limited in particle size or shape. The particle shape may range from roughly spherical or equiaxed particles to high aspect ratio particles such as fibers, whiskers or ribbons. Additionally, the conductive materials described above may be coated on a variety of other particles, also not particularly limited in shape or composition. For example the conductive inorganic material may be coated on non-conductive SiO2, $Al_2O_3$ or $TiO_2$ particles, whiskers or fibers.

The conductive agent may be a conductive "amorphous" gel such as vanadium oxide gel comprised of vanadium oxide ribbons or fibers prepared by any variety of methods, including but not specifically limited to melt quenching as described in U.S. Pat. No. 4,203,769, ion exchange as described in DE 4,125,758, or hydrolysis of a vanadium oxoalkoxide as claimed in WO 93/24584. The vanadium oxide gel may contain a dopant or be intercalated with a water-soluble vinyl containing polymer as disclosed in U.S. Ser. No. 09/161,881 incorporated herein by reference.

The conductive agent may also be a carbon filament as disclosed in U.S. Pat. No. 5,576,162, the disclosure of which is incorporated by reference herein.

Suitable electrically conductive polymers are specifically electronically conducting polymers having acceptable coloration and include substituted or unsubstituted aniline-containing polymers (as disclosed in U.S. Pat. Nos. 5,716,550; 5,093,439 and 4,070,189), substituted or unsubstituted thiophene-containing polymers (as disclosed in U.S. Pat. Nos. 5,300,575; 5,312,681; 5,354,613; 5,370,981; 5,372,924; 5,391,472; 5,403,467; 5,443,944; 5,575,898; 4,987,042 and 4,731,408), substituted or unsubstituted pyrrole-containing polymers (as disclosed in U.S. Pat. Nos. 5,665,498 and 5,674,654), and poly(isothianaphthene) or derivatives thereof. The electrically conducting polymer may be soluble or dispersible in organic solvents or water or mixtures thereof. For environmental reasons, aqueous systems are preferred. Polyanions used in the synthesis of these electrically conducting polymers are the anions of polymeric carboxylic acids such as polyacrylic acids, polymethacrylic acids or polymaleic acids and polymeric sulfonic acids such as polystyrenesulfonic acids and polyvinylsulfonic acids, the polymeric sulfonic acids being those preferred for this invention. These polycarboxylic and polysulfonic acids may also be copolymers of vinylcarboxylic and vinylsulfonic acids with other polymerizable monomers such as the esters of acrylic acid and styrene. The molecular weight of the polyacids providing the polyanions preferably is 1,000 to 2,000,000, particularly preferably 2,000 to 500,000. The polyacids or their alkali salts are commonly available, e.g., polystyrenesulfonic acids and polyacrylic acids, or they may be produced based on 10 known methods. Instead of the free acids required for the formation of the electrically conducting polymers and polyanions, mixtures of alkali salts of polyacids and appropriate amounts of monoacids may also be used. Preferred electrically conducting polymers for the present invention include polypyrrole styrene sulfonate (referred to as polypyrrole/poly (styrene sulfonic acid) in US Pat. No. 5,674,654), 3,4-dialkoxy substituted polypyrrole styrene sulfonate, and 3,4-dialkoxy substituted polythiophene styrene sulfonate. The most preferred substituted electrically conductive polymers include poly(3,4-ethylene dioxypyrrole styrene sulfonate) and poly(3,4-ethylene dioxythiophene styrene sulfonate).

Conductive clays include natural clays, such as kaolin, bentonite, and especially dispersible or delaminatable smectite clays such as montmorillonite, beidellite, hectorite, and saponite. Synthetic smectite clay materials such as a synthetic layered hydrous magnesium silicate which closely resembles the naturally occurring clay mineral hectorite in both composition and structure are preferred. Hectorite belongs to the class of clays and clay-related minerals known as "swellable" clays and is relatively rare and typically is contaminated with other minerals such as quartz or ionic species which are difficult to remove. A particularly preferred synthetic hectorite which is free from contaminants can be prepared under controlled conditions and is available commercially from Laporte Industries, Ltd. under the tradename "Laponite".

A wide variety of sulfonated polymers can be used as the film-forming binder of the electrically-conductive layer of the present invention. Preferred sulfonated polymers have been disclosed, for example, in U.S. Pat. Nos. 4,052,368; 4,307,219; 4,330,588; 4,558,149; 4,738,993; 4,746,717; 4,855,384, and 5,427,835 which are incorporated herein by reference with regards to the composition and preparation of sulfonated polymers and sulfocompounds. Preferred sulfonated polymers include sulfonated polyesters, ethyleneically-unsaturated sulfonated polymers, sulfonated polyurethanes, sulfonated polyurethane/polyureas, sulfonated polyester polyols, and sulfonated polyols. Particularly preferred sulfonated polymers include sulfonated polyurethanes, poly(sodiumstyrene sulfonate) and alkylene oxide-co-sulfonate-containing polyesters available from Eastman Chemicals, under the tradename AQ™ resins. The preferred sulfonated polyurethane binder is preferably an anionic aliphatic polyurethane dispersion in water. The preparation of polyurethanes in general and, water-dispersible polyurethanes in particular, is well known and described, for example, in U.S. Pat. Nos. 4,307,219; 4,408,008; and 3,998,870. Water-dispersible polyurethanes can be prepared by chain extending a prepolymer containing terminal isocyanate groups with a chain extension agent (an active hydrogen compound, usually a diamine or diol). The prepolymer is formed by reacting a diol or polyol having terminal hydroxyl groups with excess diisocyanate or polyisocyanate. To permit dispersion in water, water-solubilizing/dispersing groups are introduced either into the prepolymer prior to chain extension or are introduced as part of the chain extension agent. For the purpose of the present invention, suitable polyurethanes contain sulfonate groups as the water-solubilizing/dispersing groups. Suitable polyurethanes may also contain a combination of sulfonate groups and nonionic groups such as pendant polyethylene oxide chains as the water-solubilizing/dispersing groups. The sulfonate groups may be introduced by utilizing sulfonate-containing diols or polyols, sulfonate-containing-diisocyanates or polyisocyanates or sulfonate-containing-chain extension agents such as a sulfonate-containing diamines in the preparation of the water-dispersible polyurethane.

The electrically-conductive agent can constitute about 0.1 to 80 volume percent of the conductive layer of this invention. The amount of electrically-conductive agent contained in the conductive layer is defined in terms of volume percent rather than weight percent since the densities of the various suitable conductive agents vary widely. Suitable volume percents for obtaining useful electrical conductivities depend to a large extent on the volume resistivity and morphology of the conductive agent in addition to the specific imaging application. For acicular antimony-doped tin oxide particles, suitable volume percents range from about 2 to 70 volume percent, which correspond to tin oxide particle to sulfonated polymeric binder weight ratios of from approximately 1:9 to 19:1. For granular antimony-doped tin oxide or zinc antimonate particles, suitable volume percents range from about 20 to 80 volume percent; which correspond to conductive particle to binder weight ratios of from approximately 3:2 to 25:1. For colloidal vanadium oxide, suitable volume percents range from about 0.1 to 30 volume percent, which correspond to colloidal vanadium oxide to sulfonated binder weight ratios of from approximately 1:500 to 4:1. For electrically-conductive polymers suitable volume percents range from about 0.1 to 80 volume percent.

Optional polymeric film-forming cobinders suitable for use in conductive layers of this invention include: water-soluble, hydrophilic polymers such as gelatin, gelatin derivatives, maleic acid anhydride copolymers such as sulfonated styrene/maleic acid anhydride; cellulose derivatives such as carboxymethyl cellulose, hydroxyethyl cellulose, cellulose acetate butyrate, diacetyl cellulose or triacetyl cellulose; synthetic hydrophilic polymers such as polyvinyl alcohol, poly-N-vinylpyrrolidone, acrylic acid copolymers, polyacrylamide, their derivatives and partially hydrolyzed products, vinyl polymers and copolymers such as polyvinyl acetate and polyacrylate acid ester; derivatives of the above polymers; and other synthetic resins. Other suitable cobinders include aqueous emulsions of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl and vinylidene halides, and olefins and aqueous dispersions of non-sulfonated polyurethanes or polyesterionomers. Gelatin and gelatin derivatives, non-sulfonated polyurethanes, polyesterionomers, and aqueous emulsions of vinylidene halide interpolymers are the preferred cobinders.

Solvents useful for preparing dispersions and coatings containing an electrically-conductive agent by the method of this invention include: water; alcohols such as methanol, ethanol, propanol, isopropanol; ketones such as acetone, methylethyl ketone, and methylisobutyl ketone; esters such as methyl acetate, and ethyl acetate; glycol ethers such as methyl cellusolve, ethyl cellusolve; ethylene glycol, and mixtures thereof. Preferred solvents include water, alcohols, and acetone.

In addition to binders and solvents, other components that are well known in the photographic art also can be included in the conductive layer of this invention. Other addenda, such as matting agents, surfactants or coating aids, charge control agents, polymer lattices to improve dimensional stability, thickeners or viscosity modifiers, hardeners or cross-linking agents, soluble antistatic agents, soluble and/or solid particle dyes, antifoggants, lubricating agents, and various other conventional additives optionally can be present in any or all of the layers of the multilayer imaging element.

Dispersion of an electrically-conductive agent in suitable liquid vehicles can be formulated with a sulfonated film-forming binder and various addenda and applied to a variety of supports to form electrically-conductive layers of this invention. Typical photographic film supports include: cellulose nitrate, cellulose acetate, cellulose acetate butyrate, cellulose acetate propionate, poly(vinyl acetal), poly (carbonate), poly(styrene), poly(ethylene terephthalate), poly(ethylene naphthalate) or poly(ethylene naphthalate) having included therein a portion of isophthalic acid, 1,4-cyclohexane dicarboxylic acid or 4,4-biphenyl dicarboxylic acid used in the preparation of the film support; polyesters wherein other glycols are employed such as, for example, cyclohexanedimethanol, 1,4-butanediol, diethylene glycol, polyethylene glycol; ionomers as described in U.S. Pat. No. 5,138,024, incorporated herein by reference, such as polyester ionomers prepared using a portion of the diacid in the form of 5-sodiosulfo-1,3-isophthalic acid or like ion containing monomers, polycarbonates, and the like; blends or laminates of the above polymers. Supports can be either transparent or opaque depending upon the application. Transparent film supports can be either colorless or colored by the addition of a dye or pigment. Film supports can be surface-treated by various processes including corona discharge, glow discharge, UV exposure, flame treatment, electron-beam treatment, as described in U.S. Pat. No. 5,718,995; treatment with adhesion-promoting agents including dichloro- and trichloroacetic acid, phenol derivatives such as resorcinol, 4-chloro-3-methyl phenol, and p-chloro-m-cresol; and solvent washing or can be overcoated with adhesion promoting primer or tie layers containing polymers such as vinylidene chloride-containing copolymers, butadiene-based copolymers, glycidyl acrylate or methacrylate-containing copolymers, maleic anhydride-containing copolymers, condensation polymers such as polyesters, polyamides, polyurethanes, polycarbonates, mixtures and blends thereof, and the like. Other suitable opaque or reflective supports are paper, polymer-coated paper, including polyethylene-, polypropylene-, and ethylene-butylene copolymer-coated or laminated paper, synthetic papers, pigment-containing polyesters, and the like. Of these supports, films of cellulose triacetate, poly (ethylene terephthalate), and poly(ethylene naphthalate) prepared from 2,6-naphthalene dicarboxylic acids or derivatives thereof are preferred. The thickness of the support is not particularly critical. Support thicknesses of 2 to 10 mils (50 $\mu$m to 254 $\mu$m) are suitable for photographic elements in accordance with this invention.

Dispersions containing an electrically-conductive agent, a sulfonated polymeric film-forming binder, and various additives in a suitable liquid vehicle can be applied to the aforementioned film or paper supports using any of a variety of well-known coating methods. Handcoating techniques include using a coating rod or knife or a doctor blade. Machine coating methods include air knife coating, reverse roll coating, gravure coating, curtain coating, bead coating, slide hopper coating, extrusion coating, spin coating and the like, as well as other coating methods known in the art.

The electrically-conductive layer of this invention can be applied to the support at any suitable coverage depending on the specific requirements of a particular type of imaging element. For example, for silver halide photographic films, dry coating weights of the conductive layer are preferably in the range of from about 0.002 to 2 g/m$^2$. More preferred dry weight coverages are in the range of about 0.005 to 1 g/m$^2$. The conductive layer of this invention typically exhibits a surface resistivity (20% RH, 20° C.) of less than $1\times10^{10}$ ohms/square, preferably less than $1\times10^{9}$ ohms/square, and more preferably less than $1\times10^{8}$ ohms/square.

Imaging elements having a transparent magnetic recording layer are well known in the imaging art as described hereinabove. Such a transparent magnetic recording layer contains a polymeric film-forming binder, ferromagnetic particles, and other optional addenda for improved manufacturabilty or performance such as dispersants, coating aids, fluorinated surfactants, crosslinking agents or hardeners, catalysts, charge control agents, lubricants, abrasive particles, filler particles, and the like.

Suitable ferromagnetic particles include ferromagnetic iron oxides, such as: $\gamma$—$Fe_2O_3$, $Fe_3O_4$; $\gamma$—$Fe_2O_3$or $Fe_3O_4$ bulk doped or surface-treated with Co, Zn, Ni or other metals; ferromagnetic chromium dioxides such as $CrO_2$ or $CrO_2$ doped with Li, Na, Sn, Pb, Fe, Co, Ni, Zn or halogen atoms in solid solution; ferromagnetic transition metal ferrites; ferromagnetic hexagonal ferrites, such as barium and strontium ferrite; ferromagnetic metal alloys with oxide coatings on their surface to improve chemical stability and/or dispersibility. In addition, ferromagnetic oxides with a shell of a lower refractive index particulate inorganic material or a polymeric material with a lower optical scattering cross-section as taught in U.S. Pat. Nos. 5,217,804 and 5,252,444 may be used. The ferromagnetic particles can exhibit a variety of sizes, shapes and aspect ratios. The preferred ferromagnetic particles for use in magnetic layers used in combination with the conductive layers of this invention are cobalt surface-treated $\gamma$-iron oxide with a specific surface area greater than 30m$^2$/g.

As taught in U.S. Pat. No. 3,782,947, whether an element is useful for both photographic and magnetic recording depends both on the size distribution and the concentration of the ferromagnetic particles and on the relationship between the granularities of the magnetic and photographic layers. Generally, the coarser the grain of the silver halide emulsion in the photographic element containing a magnetic recording layer, the larger the mean size of the magnetic particles which are suitable. A magnetic particle coverage for the magnetic layer of from about 10 to 1000 mg/m$^2$, when uniformly distributed across the imaging area of a photographic imaging element, provides a magnetic layer that is suitably transparent to be useful for photographic imaging applications for particles with a maximum dimension of less than about 1 $\mu$m. Magnetic particle coverages less than about 10 mg/M$^2$ tend to be insufficient for magnetic recording purposes. Magnetic particle coverages greater than about 1000 mg/m$^2$ tend to produce magnetic layers with optical densities too high for photographic imaging. Particularly useful particle coverages are in the range of 20 to 70 mg/m$^2$. Coverages of about 20 mg/m$^2$ are particularly useful in magnetic layers for reversal films and coverages of about 40 mg/m$^2$ are particularly useful in magnetic layers for negative films. Magnetic particle concentrations in the coated layers of from about $1\times10^{-11}$ mg/$\mu$m$^3$ to $1\times10^{-10}$ mg/$\mu$m$^3$ are particularly preferred for transparent magnetic layers prepared for use in accordance with this invention.

Suitable polyester binders for the magnetic recording layer are aromatic polyesters having a $T_g$ of greater than 150–180° C., and preferably greater than 200° C. Suitable polyester binders are disclosed in detail in copending and commonly U.S. application Ser. No. 09/157,456 incorporated herein by reference with regards to the composition and preparation of magnetic recording layers containing an aromatic polyester binder. The preferred polyester binder is the reaction product of dibasic aromatic acids and dihydoxy phenols. Preferred dibasic aromatic acids include terephthalic acid, isophthalic acid, 2,5-dimethylterephthalic acid, 2,5-dibromoterephthalic acid, bis(4-carboxyphenel)sulfone, 1,1 ,3-trimethyl-3-(4-carboxyphenyl)-5-indanecarboxylic acid, 2,6-naphtalenedicarboxylic acid and 2,2-bis(4-carboxyphenyl)propane. Preferred dihydoxy phenols include: dihydroxyphenol is 4,4'(hexafluroisopropylidene) diphenol (bisphenol AF); 4,4'-isopropylidenediphenol (bisphenol A); 4,4'-isopropylidene-2,2'6,6'-tetrachlorobisphenol; 4,4'-isopropylidene-2,2'6,6'-tetrabromobisphenol; 4,4'-(hexahydro-4,7-methanoinden-5-ylidene) bisphenol; 4,4'-(2-norbornylidine) bisphenol; 9,9-bis-(4-hydroxyphenol) fluorene, bis(4-hydroxyphenyl) diphenol methane; 1,4-bis(p-hydroxycumyl)benzene; 1,3bis (p-hydroxycumyl)benzene; 4,4'-oxybisphenol, hydroxyquinone or resorcinol.

The transparent magnetic layer can be positioned in an imaging element in any of various positions. For example, it can overlie one or more image-forming layers, or underlie one or more image forming layers, or be interposed between image-forming layers, or serve as a subbing layer for an image-forming layer, or be coated on the side of the support opposite to an image-forming layer. In a silver halide photographic element, the transparent magnetic layer is preferably on the side of the support opposite the silver halide emulsion.

Conductive layers of this invention can be incorporated into multilayer imaging elements in any of various configurations depending upon the requirements of the specific imaging element. The conductive layer may be present as a subbing or tie layer underlying the magnetic recording on the side of the support opposite the imaging layer(s). Conductive layers also may be located on the same side of the support as the imaging layer(s) or on both sides of the support. A conductive subbing layer also can be applied either under or over a gelatin subbing layer containing an antihalation dye or pigment. Alternatively, both antihalation and antistatic functions can be combined in a single layer containing conductive particles, antihalation dye, and a binder. This hybrid layer is typically coated on the same side of the support as the sensitized emulsion layer. Additional optional layers can be present as well. The conductive layer and magnetic layer of this invention are preferably located on the side of the support opposite the imaging layer. Other addenda, such as polymer lattices to improve dimensional stability, hardeners or cross-linking agents, surfactants, matting agents, lubricants, and various other well-known additives can be present in any or all of the above mentioned layers.

Conductive layers of this invention underlying a transparent magnetic recording layer typically exhibit an internal resistivity (wet electrode resistivity) of less than $1\times10^{11}$ ohm/square, preferably less than $1\times10^{10}$ ohm/square, and more preferably, less than $1\times10^{9}$ ohm/square after overcoating with the transparent recording layer.

In a particularly preferred embodiment, imaging elements of this invention are photographic elements, which can differ widely in structure and composition. For example, said photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure*, Item 36230 (June 1994). Photographic elements can be either simple black-and-white or monochrome elements or multilayer and/or multicolor elements adapted for use in a negative-positive process or a reversal process. Suitable photosensitive image-forming layers are those which provide color or black and white images. Such photosensitive layers can be image-forming layers containing silver halides such as silver chloride, silver bromide, silver bromoiodide, silver chlorobromide and the like. Both negative and reversal silver halide elements are contemplated. For reversal films, the emulsion layers described in U.S. Pat. No. 5,236,817, especially examples 16 and 21, are particularly suitable. Any of the known silver halide emulsion layers, such as those described in *Research Disclosure*, Vol. 176, Item 17643 (December, 1978) and *Research Disclosure*, Vol. 225, Item 22534 (January, 1983), and *Research Disclosure*, Item 36544 (September, 1994), and *Research Disclosure*, Item 37038 (February, 1995) and the references cited therein are useful in preparing photographic elements in accordance with this invention. Generally, the photographic element is prepared by coating the film support on the side opposite the transparent magnetic recording layer with one or more layers containing a silver halide emulsion and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure*, Vol. 176, Item 17643 (December, 1978).

Imaging elements incorporating conductive layers in combination with transparent magnetic recording layers in accordance with this invention also can comprise additional layers including adhesion-promoting layers, lubricant or transport-controlling layers, hydrophobic barrier layers, antihalation layers, abrasion and scratch protection layers, and other special function layers. Imaging elements of this invention incorporating conductive layers containing a sulfonated polymeric binder in combination with transparent magnetic recording layer containing an aromatic polyester having a $T_g$ greater than 150–180° C., preferably greater than 200° C., useful for specific imaging applications such as color negative films, color reversal films, black-and-white films, color and black-and-white papers, electrographic media, dielectric recording media, thermally processable imaging elements, thermal dye transfer recording media, laser ablation media, ink jet media and other imaging applications should be readily apparent to those skilled in photographic and other imaging arts.

The method of the present invention is illustrated by the following detailed examples of its practice. However, the scope of this invention is by no means limited to these illustrative examples.

EXAMPLE 1

An antistatic layer coating formulation containing colloidal silver-doped vanadium oxide dispersed in water with a sulfonated polyester, and a coating aid was prepared at nominally 0.20 weight percent solids. The colloidal vanadium oxide was prepared by the melt-quenching technique as taught by Guestaux in U.S. Pat. No. 4,203,769. The weight ratio of colloidal vanadium oxide to sulfonated polyurethane binder was nominally 1/4. The coating formulation is given below:

| Component | Weight % (wet) |
|---|---|
| Sulfonated polyester dispersion (AQ55D Eastman Chemical Co.) | 0.133% |
| Wetting aid (Triton X-100) | 0.033% |
| Colloidal vanadium oxide | 0.033% |
| Water | balance |

The above coating formulation was applied to a moving 4 mil polyethylene terephthalate support using a coating hopper so as to provide a nominal total dry coverage of 45 mg/m$^2$. The support had been coated previously with a typical subbing layer containing a vinylidene chloride-based terpolymer latex.

The resulting conductive layer was overcoated with a polyester-based transparent magnetic recording layer as described in copending and commonly assigned U.S. Ser. No. 09/157,456 to provide a nominal total dry coverage of 1.6 g/m$^2$. The electrically-conductive layer and overlying transparent magnetic recording layer with optional lubricant layers is referred to as a magnetic backing package. The magnetic coating formulation is given below:

| Component | Weight % (wet) |
|---|---|
| Polyester binder | 3.047 |
| Magnetic oxide Toda CSF-4085V2 | 0.129 |
| Dispersing Aid, Zeneca Solsperse 24000 | 0.033 |
| Dibutyl Phthalate | 0.149 |
| Alumina Sumitomo AKP-50 | 0.110 |
| 3M FC-431 | 0.014 |
| Dichloromethane | 76.951 |
| 2-Methyl Bthyl Ketone | 19.567 |

Antistatic performance was evaluated by measuring the internal electrical resistivity using a salt bridge wet electrode resistivity (WER) measurement technique (as described, for example, in "Resistivity Measurements on Buried Conductive Layers" by R. A. Elder, pages 251–254, 1990 *EOS/ESD Symposium Proceedings*). Typically, antistatic layers with WER values greater than about $1\times10^{12}$ ohm/square are considered to be ineffective at providing static protection for photographic imaging elements Dry adhesion of the magnetic backing package was evaluated by scribing a small region of the coating with a razor blade. A piece of high-tack adhesive tape was placed over the scribed region and quickly removed multiple times. The number of times the adhesive tape could be removed without any coating removal is a qualitative measure of the dry adhesion. Dry adhesion was evaluated both before and after photographic processing by the standard C-41 process. Wet adhesion was evaluated using a procedure which simulates wet processing of silver halide photographic elements. A one millimeter wide line was scribed into a sample of the magnetic backings package. The sample was then immersed in KODAK Flexicolor developer solution at 38° C. and allowed to soak for 3 minutes and 15 seconds. The test sample was removed from the heated developer solution and then immersed in another bath containing Flexicolor developer at about 25° C. and a rubber pad (approximately 3.5 cm dia.) loaded with a 900 g weight was rubbed vigorously back and forth across the sample in the direction perpendicular to the scribe line. The relative amount of additional material removed is a qualitative measure of the wet adhesion of the various layers. Total optical and ultraviolet densities ($D_{min}$) of the backings packages were measured using a X-Rite Model 361T B&W transmission densitometer at 650 and 380 nm, respectively. The contributions of the polymeric support and any optional primer layers to the optical and ultraviolet densities were subtracted from the total $D_{min}$ values to obtain Δ UV and Δ ortho $D_{min}$ values which correspond to the net contribution of the magnetic backing package to the total ultraviolet and optical densities. WER values, adhesion results, and net optical and ultraviolet densities are given in Table 1.

COMPARATIVE EXAMPLE 1

A conductive layer containing colloidal silver-doped vanadium oxide dispersed in a sulfonated polyester was prepared in an identical manner to Example 1. The resulting conductive layer was overcoated with a cellulose diacetate based transparent magnetic recording layer as disclosed in U.S. Pat. No. 5,514,528 and others, to provide a nominal total dry coverage of 1.6 g/m$^2$. The magnetic coating formulation is given below. WER values, adhesion results, and net optical and ultraviolet densities are given in Table 1.

| Component | |
|---|---|
| Cellulose diacetate | 2.51 g |
| Cellulose triacetate | 0.115 g |
| Magnetic oxide Toda CSF-4085V2 | 0.113 g |
| Surfactant Rhodafac PE510 | 0.006 g |
| Alumina Norton E-600 | 0.076 g |
| Dispersing Aid, Zeneca Solsperse 24000 | 0.004 g |
| 3MFC41 | 0.015 g |
| Dichloromethane | 67.919 g |
| Acetone | 24.257 g |
| Methyl acetoacetate | 4.851 g |

EXAMPLES 2–3 AND COMPARATIVE EXAMPLES 2–3

Aqueous antistatic dispersions containing a polythiophene dispersed in water with a sulfonated polyester, and a coating aid were prepared at nominally 2 and 1 weight percent solids for Examples 2 and 3, respectively. The polythiophene used in the present examples was a polyethylene dioxythiophene commercially available from Bayer Corporation under the tradename Baytron P. The antistatic coating formulations are given below:

| Component | Examples 2 | Examples 3 |
|---|---|---|
| Sulfonated polyester dispersion (AQ55D Eastman Chemical Co.) 10% | 18.0% | 8.0% |
| Wetting aid (Pluronic F88) 10% | 0.7% | 0.7% |
| Polythiophene, (Baytron P) 1.2% | 16.4% | 16.4% |
| Water | 64.9% | 74.9% |

The above coating formulations were applied to a moving 4 mil polyethylene terephthalate support using a coating hopper so as to provide a nominal total dry coverage of 0.6 g/m$^2$. The support had been coated previously with a typical subbing layer containing a vinylidene chloride-based terpolymer latex.

The resulting antistatic layers were overcoated with the polyester-based magnetic layer of Example 1 for Examples 2 and 3 or with the cellulose diacetate-based magnetic layer of Comparative Example 1 for Comparative Examples 2 and 3. WER values, adhesion results, and net optical and ultraviolet densities are given in Table 1.

EXAMPLE 4 AND COMPARATIVE EXAMPLE 4

An aqueous antistatic dispersion containing the polythiophene of Example 2 dispersed in water with a sulfonated polyurethane, and a coating aid was prepared at nominally 2 weight percent solids. The sulfonated polyurethane used in the present example was commercially available from Bayer Corporation under the trade name Bayhydrol PR 240. The antistatic coating formulation is given below:

| Component | Example 4 |
|---|---|
| Sulfonated polyurethane dispersion (PR240 Bayer Corp.) 10% | 18.0% |
| Wetting aid (Pluronic F88 BASF Corp) 10% | 0.7% |
| Polythiophene (Baytron P) | 16.4% |

The above coating formulation was applied to a moving 4 mil polyethylene terephthalate support using a coating hopper so as to provide a nominal total dry coverage of 0.6 g/m$^2$. The support had been coated previously with a typical subbing layer containing a vinylidene chloride-based terpolymer latex.

The resulting antistatic layers were overcoated with the polyester-based magnetic layer (Example 4) of Example 1 or with the cellulose diacetate-based magnetic layer (Comparative Example 4) of Comparative Example 1. WER values, adhesion results, and net optical and ultraviolet densities are given in Table 1.

EXAMPLE 5 AND COMPARATIVE EXAMPLE 5

An aqueous dispersion of polypyrrole/poly(styrene sulfonic acid) was prepared by oxidative polymerization of pyrrole in an aqueous solution in the presence of poly (styrene sulfonic acid) using ammonium persulfate as the oxidant, according to U.S. Pat. No. 5,674,654. An antistatic layer coating formulation containing polypyrrole/poly (styrene sulfonic acid) dispersed in water with a sulfonated polyurethane aqueous dispersion, commercially available from Bayer Corporation under the trade name Bayhydrol PR 240, and a coating aid, Pluronic F88 (BASF Corporation) was prepared at nominally 4.1 wt%. The coating formulation is given below:

| Component | Weight % (wet) |
|---|---|
| Polyurethane dispersion (Bayhydrol PR 240 Bayer Corp.) | 3.2% |
| Wetting aid (Pluronic F88 BASF Corp.) | 0.1% |
| Polypyrrole/poly(styrene sulfonic acid) | 0.8% |
| Water | 95.9% |

The above coating formulation was applied to a moving polyethylene naphthalate support using a coating hopper so as to provide a nominal total dry coverage of 0.3 g/m$^2$. The support had been coated previously with a typical subbing layer containing a vinylidene chloride-based terpolymer latex.

The resulting conductive layers were overcoated with transparent magnetic recording layers as described in Example 1 (Example 5) and Comparative Example 1 (Comparative Example 5). WER values, adhesion results, and net optical and ultraviolet densities are given in Table 1.

EXAMPLE 6 AND COMPARATIVE EXAMPLE 6

An antistatic layer coating formulation containing antimony-doped tin oxide dispersed in water with sulfonated polyurethane Bayhydrol PR 240 and a coating aid was prepared at nominally 3.5 weight percent solids. The coating formulation is given below:

| Component | Weight % (wet) |
|---|---|
| Polyurethane dispersion (Bayhydrol PR 240 Bayer Corp.) | 1.019% |
| Wetting aid (Pluronic F88 BASF Corp.) | 0.100% |
| Tin oxide (SN100D, Ishihara Sangyo Kaisha Ltd) | 2.378% |
| Water | 99.503% |

The above coating formulation was applied to a moving polyethylene naphthalate support using a coating hopper so as to provide a nominal total dry coverage of 0.3 g/m$^2$. The support had been coated previously with a typical subbing layer containing a vinylidene chloride-based terpolymer latex. The resulting conductive layers were overcoated with a transparent magnetic recording layer as described in Example 1 or Comparative Example 1 for Example 6 and Comparative Example 6, respectively). WER values, adhesion results, and net optical and ultraviolet densities are given in Table 1.

EXAMPLE 7 AND COMPARATIVE EXAMPLE 7

An antistatic layer coating formulation consisting of acicular antimony-doped tin oxide dispersed in water with a sulfonated polyurethane, Bayhydrol PR 240, and a coating aid was prepared at nominally 3.5 weight percent solids. The acicular tin oxide used in the present Example was FS-10D, commercially available from Ishihara Sangyo Kaisha Ltd. The coating formulation is given below:

| Component | Weight % (wet) |
|---|---|
| Polyurethane dispersion (Bayhydrol PR 240 Bayer Corp.) | 1.019% |
| Wetting aid (Pluronic F88 BASF Corp.) | 0.100% |

-continued

| Component | Weight % (wet) |
|---|---|
| Tin oxide (FS-10D, Ishihara Sangyo Kaisha Ltd) | 2.378% |
| Water | 99.503% |

The above coating formulation was applied to a moving polyethylene naphthalate support using a coating hopper so as to provide a nominal total dry coverage of 0.6 g/m$^2$. The support had been coated previously with a typical subbing layer containing a vinylidene chloride-based terpolymer latex. The resulting conductive layers were overcoated with a transparent magnetic recording layer as described in Example 1 or Comparative Example 1 for Example 7 and Comparative Example 7, respectively). WER values, adhesion results, and net optical and ultraviolet densities are given in Table 1.

cially available from Bayer Corporation, which contains neutralized carboxylic acid groups as the polyurethane solubilizing/dispersing groups, as recommended by U.S. Pat. No. 5,391,472 but are not sulfonated, as taught by the present invention. Comparative Examples 11–14, respectively, used Witcobond W-160, W-213, W-236, and W-320 all commercially available from Witco Corporation. Witcobond W-236 is an aliphatic, anionic polyurethane having an ultimate elongation to break of at least 350 percent as taught in U.S. Pat. No. 5,718,995 to be particularly useful in combination with a transparent magnetic recording layer and with energetic surface treatments. The antistatic coating formulations for Comparative Examples 10–14 resulted in coagulation, rendering them unsuitable for coating, indicating incompatibility of non-sulfonated polyurethane binders with electrically-conducting polypyrrole/poly(styrene sulfonic acid).

TABLE 1

| Sample | Antistatic layer binder | Magnetic layer binder | Wet adh | Dry Adh | Processed Dry Adh | WER log Ω/sq | ΔUV $D_{min}$ | Δortho $D_{min}$ |
|---|---|---|---|---|---|---|---|---|
| Example 1 | sulfopolyester | PE | excellent | excellent | excellent | 7.1 | 0.187 | 0.060 |
| Example 2 | sulfopolyester | PE | very good | excellent | excellent | 8.4 | 0.190 | 0.076 |
| Example 3 | sulfopolyester | PE | good | excellent | excellent | 7.3 | 0.201 | 0.094 |
| Example 4 | sulfopolyurethane | PE | poor | excellent | excellent | 7.3 | 0.192 | 0.078 |
| Example 5 | sulfopolyurethane | PE | excellent | excellent | excellent | 8.8 | 0.229 | 0.123 |
| Example 6 | sulfopolyurethane | PE | excellent | excellent | excellent | 8.5 | 0.176 | 0.062 |
| Example 7 | sulfopolyurethane | PE | excellent | excellent | excellent | 7.2 | 0.181 | 0.065 |
| Comp. Ex. 1 | sulfopolyester | CDA | excellent | excellent | poor | 7.1 | 0.202 | 0.066 |
| Comp. Ex. 2 | sulfopolyester | CDA | very good | poor | poor | 8.3 | 0.205 | 0.083 |
| Comp. Ex. 3 | sulfopolyester | CDA | good | poor | poor | 7.1 | 0.218 | 0.097 |
| Comp. Ex. 4 | sulfopolyurethane | CDA | poor | excellent | poor | 7.3 | 0.208 | 0.083 |
| Comp. Ex. 5 | sulfopolyurethane | CDA | good | excellent | poor | 8.8 | 0.224 | 0.117 |
| Comp. Ex. 6 | sulfopolyurethane | CDA | excellent | excellent | poor | 8.8 | 0.173 | 0.062 |
| Comp. Ex. 7 | sulfopolyurethane | CDA | excellent | excellent | good | 7.3 | 0.180 | 0.068 |
| Comp. Ex. 8 | none | PE | very poor | fair | poor | 6.7 | 0.191 | 0.077 |
| Comp. Ex. 9 | none | CDA | very poor | poor | poor | 6.7 | 0.203 | 0.078 |

PE = polyester based magnetic layer
CDA = cellulose diacetate based magnetic layer

COMPARATIVE EXAMPLES 8 and 9.

An antistatic coating formulation consisting of a conductive polythiophene, Baytron P, dispersed in water with a coating aid (i.e., no binder) was applied to a moving web of polyethylene terephthalate so as to provide a nominal total dry coverage of 0.05 g/m 2. The support had been coated previously with a typical subbing layer containing a vinylidene chloride-based terpolymer latex. The resulting conductive layers were overcoated with either a polyester-based magnetic recording layer as described in Example 1 or a cellulose acetate-based megnetic recording layer as described in Comparative Example 1 for Comparative Examples 8 and 9, respectively). WER values, adhesion results, and net optical and ultraviolet densities are given in Table 1.

COMPARATIVE EXAMPLES 10–14

Antistatic coating formulations composed of polypyrrole/poly(styrene sulfonic acid) dispersed in water with a dipsersed polyurethane were prepared in a similar manner to Example 5, however, the polyurethane binder was not a sulfonated polyurethane according to the present invention. Comparative Example 10 used Bayhydrol 123, commer- The above examples clearly demonstrate that the combination of an electrically-conductive layer containing a sulfonated polymeric binder and a transparent magnetic recording layer containing an aromatic polyester having a $T_g$ greater than 150° C., preferably greater than 180° C. according to the present invention provides a magnetic backing backage having improved adhesion particularly after photographic processing than prior art magnetic backing pacakges containing a sulfonated polymeric binder. Furthermore, the sulfonated polymeric binder provides coating formulations having improved stability or compatibility with a wide variety of electrically-conductive agents. In particular, stability is greatly improved for electrically-conductive polymers such as poly(pyrrole)/poly(styrene sulfonic acid) and for conductive colloidal gels such as colloidal vanadium oxide relative to similar coating formulations containing a non-sulfonated polyurethane binder.

The invention has been described in detail with particular reference to certain preferred embodiments thereof, but it will be understood that variations and modifications can be effected within the spirit and scope of the invention.

What is claimed is:

1. An imaging element comprising:

a support;

an image-forming layer superposed on the support;

an electrically-conductive layer superposed on the support comprising a sulfonated polymeric film-forming binder and an electrically-conductive agent; and a transparent magnetic recording layer overlying said electrically-conductive layer; said transparent magnetic recording layer comprising ferromagnetic particles and an aromatic polyester binder having a $T_g$ of greater than 150° C.

2. The imaging element of claim 1, wherein the electrically-conductive agent comprises electrically-conductive particles, electrically-conductive amorphous gels, electrically-conductive polymers, carbon fibers or conductive swellable clays.

3. The imaging element of claim 2, wherein the electrically-conductive particles comprise semiconductive metal oxides, metal oxides containing oxygen deficiencies, conductive metal carbides, conductive metal nitrides, conductive metal silicides, conductive metal borides, doped metal oxides, metal oxide particles, zinc antimonate, indium antimonate, metal nitrides, metal carbides, metal silicides, or metal borides.

4. The imaging element of claim 2, wherein the electrically-conductive amorphous gel comprises colloidal vanadium oxide.

5. The imaging element of claim 1, wherein the electrically-conductive agent comprises a 0.1 to 80 volume percent of said electrically-conductive layer.

6. The imaging element of claim 1, wherein said electrically-conductive layer comprises a dry weight coverage of from 2 to 2000 $mg/m^2$.

7. The imaging element of claim 1, wherein said electrically-conductive layer has a surface resistivity of less than $1\times10^{10}$ ohms per square.

8. The imaging element of claim 1, wherein said support comprises poly(ethylene terephthalate) film, cellulose acetate film or poly(ethylene naphthalate) film.

9. The imaging element of claim 1, wherein the sulfonated polymeric film-forming binder comprises sulfonated polyesters, ethyleneically-unsaturated sulfonated polymers, sulfonated polyurethanes, sulfonated polyurethane/polyureas, sulfonated polyester polyols, or sulfonated polyols.

10. The imaging element of claim 1, wherein the transparent magnetic recording layer comprises cobalt surface modified γ-iron oxide particles.

11. The imaging element of claim 10, wherein the cobalt surface modified γ-iron oxide particles comprise a dry weight coverage of from 10 $mg/m^2$ to 1000 $mg/m^2$.

12. A photographic film comprising:

(1) a support;

(2) a silver halide emulsion layer on a side of said support;

(3) a transparent magnetic recording layer on an opposite side of said support; said transparent magnetic recording layer comprising ferromagnetic particles dispersed in an aromatic polyester binder having a $T_g$ greater than 150° C.; and (4) an electrically-conductive layer underlying said transparent magnetic recording layer; said electrically-conductive layer comprising a sulfonated polymeric film-forming binder and an electrically-conductive agent.

13. An imaging element according to claim 3, wherein said electrically-conductive particles are doped tin oxide particles, niobium-doped titanium dioxide particles, or tin-doped indium sesquioxide.

14. An imaging element according to claim 3, wherein said electrically-conductive particles are acicular doped metal oxides, acicular metal oxide particles, acicular metal oxides containing oxygen deficiencies, acicular metal nitrides, acicular metal carbides, acicular metal silicides, and acicular metal borides.

15. An imaging clement according to claim 3, wherein said electrically-conductive particles are selected from acicular doped tin oxide particles, acicular niobium-doped titanium dioxide particles, and acicular tin-doped indium sesquioxide.

16. The imaging element of claim 2 wherein the electrically-conductive polymer comprises substituted aniline-containing polymers, unsubstituted aniline-containing polymers, substituted thiophene-containing polymers, unsubstituted thiophene-containing polymers substituted pyrrole-containing polymers, unsubstituted pyrrole-containing polymers, or poly(isothianaphthene).

17. An imaging element according to claim 3, wherein said electrically-conductive particles include antimony-doped tin oxide particles.

18. An imaging clement according to claim 3, wherein said electrically-conductive particles include acicular antimony-doped tin oxide particles.

* * * * *